United States Patent [19]

Joco

[11] Patent Number: 4,705,463

[45] Date of Patent: Nov. 10, 1987

[54] COMPRESSOR WHEEL ASSEMBLY FOR TURBOCHARGERS

[75] Inventor: Fidel M. Joco, Long Beach, Calif.

[73] Assignee: The Garrett Corporation, Los Angeles, Calif.

[21] Appl. No.: 873,265

[22] Filed: Jun. 6, 1986

Related U.S. Application Data

[63] Continuation of Ser. No. 487,144, Apr. 21, 1983, abandoned.

[51] Int. Cl.[4] ..... F16D 1/00

[52] U.S. Cl. ..... 417/407; 416/244 A; 416/241 R; 29/156.8 CF

[58] Field of Search ..... 416/244 R, 244 A, 213 R, 416/241 R; 415/170 R, 170 A, 212; 417/407; 228/112–114; 29/156.8 CF

[56] References Cited

U.S. PATENT DOCUMENTS

| | | | |
|---|---|---|---|
| 1,912,408 | 6/1933 | Schelhammer | 416/244 X |
| 2,010,525 | 8/1935 | McHugh | 416/244 X |
| 2,438,866 | 3/1948 | Rockwell et al. | 416/244 R |
| 2,577,134 | 12/1951 | Land | 416/244 X |
| 2,602,683 | 7/1952 | Aue | 416/244 X |
| 2,633,804 | 4/1953 | Bruce | 417/360 |
| 2,695,131 | 11/1954 | Price | 415/126 UX |
| 2,722,101 | 11/1955 | Wosika | 417/408 |
| 2,750,892 | 6/1956 | Johnson | 417/409 |
| 2,795,371 | 6/1957 | Buchi, Sr. et al. | 416/244 X |
| 2,839,006 | 6/1958 | Mayo | 417/360 X |
| 2,912,155 | 11/1959 | Buchi | 416/244 X |
| 2,945,619 | 7/1960 | McLure | 417/406 |
| 3,037,458 | 6/1962 | Olmstead et al. | 416/244 X |
| 3,232,043 | 2/1966 | Birmann | 417/406 |
| 3,421,201 | 1/1969 | Oberle et al. | 228/113 |
| 3,451,343 | 6/1969 | Kabele | 415/128 |
| 3,510,230 | 5/1970 | Raub | 415/173 |
| 3,571,906 | 3/1971 | Barth | 416/244 |
| 3,676,014 | 7/1972 | Bevan et al. | 416/244 R UX |
| 3,890,780 | 6/1975 | Hagemeister et al. | 417/408 |
| 3,914,067 | 10/1975 | Leto | 416/244 A |
| 3,961,867 | 6/1976 | Woollenweber | 416/244 X |
| 4,039,268 | 8/1977 | Cotton | 416/244 A |
| 4,074,946 | 2/1978 | Swearingen | 416/244 A X |
| 4,095,856 | 6/1978 | Palmer | 415/407 X |
| 4,147,468 | 4/1979 | Murakami et al. | 416/244 X |
| 4,279,576 | 7/1981 | Okano et al. | 416/244 A X |
| 4,296,934 | 10/1981 | Atkin | 415/170 A X |

FOREIGN PATENT DOCUMENTS

| | | | |
|---|---|---|---|
| 2022120 | 11/1971 | Fed. Rep. of Germany | 416/244 A |
| 2734747 | 7/1977 | Fed. Rep. of Germany . | |
| 1379399 | 10/1964 | France | 228/112 |
| 35131 | 3/1980 | Japan | 416/244 A |
| 630842 | 12/1949 | United Kingdom . | |
| 898164 | 2/1961 | United Kingdom . | |
| 882572 | 11/1961 | United Kingdom . | |
| 891278 | 3/1962 | United Kingdom . | |
| 1501219 | 2/1978 | United Kingdom . | |
| 2091380 | 7/1982 | United Kingdom . | |

*Primary Examiner*—Robert E. Garrett
*Assistant Examiner*—Joseph M. Pitko
*Attorney, Agent, or Firm*—Stuart O. Lowry; J. Henry Muetterties; James W. McFarland

[57] ABSTRACT

A compressor wheel assembly for turbochargers and the like comprises a compressor wheel including a boreless hub formed integrally as by casting with a circumferential array of aerodynamically contoured centrifugal impeller blades. The wheel hub is secured at its base by inertia welding to a thrust spacer sleeve having an internally threaded bore for threaded reception of a rotatable shaft. In use of the compressor wheel assembly, the absence of a bore within the wheel hub substantially improves wheel fatigue life.

20 Claims, 6 Drawing Figures

COMPRESSOR WHEEL ASSEMBLY FOR TURBOCHARGERS

This application is a continuation of application Ser. No. 487,144 filed Apr. 21, 1983, now abandoned.

BACKGROUND OF THE INVENTION

This invention relates generally to centrifugal compressor wheels or impellers of the general type used commonly with turbochargers, superchargers, and the like. More specifically, this invention relates to an improved centrifugal compressor wheel and its method of manufacture, wherein the compressor wheel is designed for substantially prolonged fatigue life.

Centrifugal compressor wheels in general are well known for use in turbochargers, superchargers, and the like wherein the wheel comprises an array of aerodynamically contoured impeller blades supported by a central hub section which is in turn mounted on a rotatable shaft for rotation therewith. In the context of a turbocharger, by way of example, the hub section conveniently includes a central axial bore through which the shaft extends, and a nut is fastened over the shaft at the nose end of the wheel to hold the hub section tightly against a shaft shoulder or other diametrically enlarged structure rotatable with the shaft. The shaft thereby rotatably drives the compressor wheel in a direction such that the contoured blades axially draw in air and discharge that air radially outwardly at an elevated pressure level into a volute-shaped chamber of a compressor housing. The pressurized air is then supplied from the chamber to the air intake manifold of a combustion engine for admixture and combustion with fuel, all in a well-known manner.

In recent years, improvements in compressor technology and design have resulted in progressive increases in compressor efficiencies and flow ranges, together with more rapid transient response characteristics. For example, compressor wheels for turbochargers are well known wherein the impeller blades exhibit compound and highly complex curvatures designed for optimum operational efficiency and flow range. Such complex blade shape is most advantageously and economically obtained by a casting process wherein the wheel hub section and blades are integrally formed desirably from a lightweight material, such as aluminum or aluminum alloy chosen for its relatively low rotational inertia for achieving the further advantage of rapid accelerative response during transient operating conditions.

Cast compressor wheels of this general type, however, have a relatively short, finite fatigue life resulting in undesired incidence of fatigue failure during operation. More specifically, when the compressor wheel is rotated at operating speeds up to 100,000 rpm or more, the cast aluminum material is subjected to relatively high tensile loading in a radial direction particularly in the hub region of the wheel which must support the radial wheel mass. The impact of this tensile loading can be especially severe when the wheel is operated in a relatively high-speed, rapid speed cycle environment, such as, for example, turbochargers used with earth-moving equipment, front-end loaders, back hoes, and the like. Unfortunately, the hub region of the cast wheel includes a major void, namely, the central bore for reception of the rotatable shaft, wherein this central bore acts as a major stress riser rendering the wheel highly susceptible to fatigue failure in the hub region. This fatigue problem is compounded by the presence of metallurgical imperfections such, as dross, voids, and inclusions, which occur inherently as part of the casting process and which tend to congregate in the hub region of the wheel.

It is known that fatigue failures in compressor wheels can be significantly reduced, or alternately stated, the fatigue life of the compressor wheel can be substantially prolonged by forming the wheel from a noncast material, such as a forged or wrought aluminum or aluminum alloy, thereby avoiding the internal imperfections inherently resulting from a casting process. However, such noncast compressor wheels have not been practical from a cost or manufacturing standpoint primarily due to the complex machining requirements to form the impeller blades with the desired aerodynamic contours.

The present invention overcomes the problems and disadvantages of prior compressor wheels by providing an improved compressor wheel assembly including a boreless compressor wheel, wherein the boreless compressor wheel exhibits substantially prolonged fatigue life and is adapted for quick and easy mounting onto the rotating shaft of a turbocharger of the like.

SUMMARY OF THE INVENTION

In accordance with the invention, a compressor wheel assembly is provided for connection to the rotating shaft of a turbocharger, supercharger, or the like. The compressor wheel assembly comprises a boreless compressor wheel including a circumferential array of centrifugal impeller blades having an aerodynamic contour for optimized operational efficiency and flow range. The boreless compressor wheel is advantageously formed from a lightweight and low inertia material, such as aluminum or aluminum alloy and is connected at its base to a thrust spacer sleeve of a suitable material for threaded attachment to a rotating shaft of a turbocharger or the like.

In accordance with the preferred form of the invention, the boreless compressor wheel is formed by a casting process to include a boreless wheel hub integrally supporting the contoured impeller blades. The thrust spacer sleeve is formed from machined tool steel or the like to a generally cylindrical shape and is secured by inertia welding to the base of the boreless wheel hub in a position centered on a central axis of the wheel. Once attached, the thrust spacer sleeve is machined for inner and outer diameter concentricity and threads are formed on its inner diameter surface. In addition, the base of the wheel is machined to a desired aerodynamic contour and surface finish and further to remove any upset or flash material from the wheel-sleeve interface which may have been generated during the welding process.

The thus-formed compressor wheel assembly is quickly and easily installed onto the rotating shaft of a turbocharger or the like by reception of a threaded end of the shaft into the threaded thrust spacer sleeve. In the preferred form of the invention, such threaded connection positions the thrust spacer sleeve within a shaft opening in a compressor backplate wall separating a compressor housing encasing the boreless compressor wheel from a so-called center housing including thrust and journal bearings supported the rotating shaft. The sleeve is threaded onto the shaft into axially abutting engagement with a thrust collar on the shaft whereby the sleeve comprises a portion of a thrust bearing assembly. In addition, the sleeve may support seal rings in engagement with the backplate wall to block passage of lubricant through the shaft opening therein.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a perspective view illustrating a centrifugal compressor wheel for use with a turbocharger or the like;

FIG. 3 is an enlarged vertical section of the compressor wheel assembly in completed form ready for installation into a turbocharger or the like;

DETAILED DESCRIPTION OF THE PREFERRED EMBODIMENT

Figure 4:
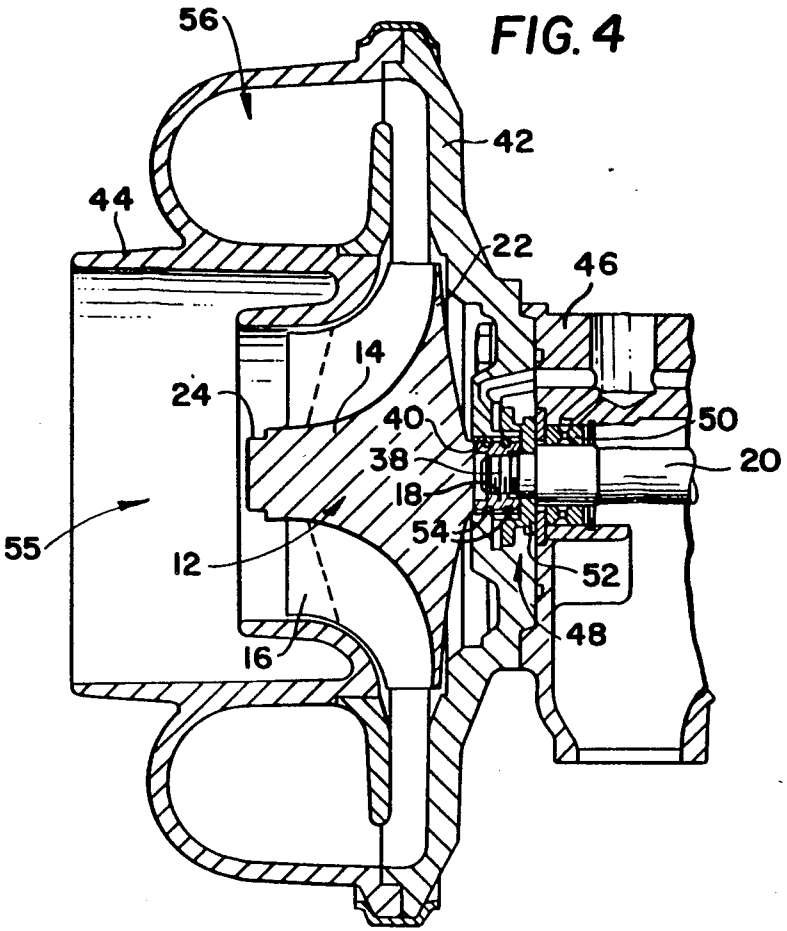
FIG. 4 is a fragmented vertical section illustrating the compressor wheel assembly of FIG. 3 installed into a turbocharger.

As shown in the exemplary drawings, a compressor wheel assembly referred to generally by the reference numeral 10 is provided for use as a centrifugal impeller in a turbocharger, supercharger, or the like. The compressor wheel assembly 10 comprises a boreless compressor wheel 12 having a hub 14 integrally supporting a circumferential array of contoured centrifugal impeller blades 16, wherein the hub is attached to a cylindrical thrust spacer sleeve 18 adapted for facilitated connection to the rotatable shaft 20 of a turbocharger or the like.

The compressor wheel assembly 10 of this invention provides substantial improvements in wheel fatigue life over conventional centrifugal compressor wheels of the type used in turbochargers, superchargers, and the like, without sacrificing efficiency and flow range in accordance with a preferred aerodynamic contouring of the impeller blades 16. This blade contouring includes complex and compound blade curvatures which effectively prohibit manufacture of the blades by any means other than a casting process, such as a rubber pattern or lost wax process. Alternately stated, this complex blade contouring renders other forming techniques, such as forging, machining, and the like, impossible or economically unfeasible. Accordingly, in the past, centrifugal compressor wheels for turbochargers have been formed from a unitary casting wherein the blades are cast integrally with a wheel hub. However, a central axial bore is then formed in the cast wheel as by drilling for reception of and installation onto the rotating shaft of a turbocharger or the like, all in a well-known manner. To minimize rotational inertia of the compressor wheel and thereby achieve a desired rapid response to transient operating conditions, the cast wheel is normally formed from aluminum or a lightweight aluminum alloy.

However, cast wheels of aluminum or aluminum alloy including the central bore for mounting purposes are susceptible to fatigue failures in response to tensile loading acting in a radial direction as the wheel is rotatably accelerated and decelerated during operation. Such failures occur most frequently in the region of the central bore whereat tensile loading is highest and further wherein the bore itself acts as a major stress riser. Moreover, in a cast wheel, metallurgical imperfections, such as dross, voids, and inclusions, are inherently created and tend to congregate near the central bore to provide additional initiation sites for stress cracks.

The compressor wheel assembly 10 of this invention advantageously avoids formation of any bore or other cavity formed internally within the compressor wheel 12 thereby removing from the wheel the most prominent stress riser and resulting in a substantial increase in wheel fatigue life. The boreless compressor wheel 12 is provided with alternative means in the form of the thrust spacer sleeve 18 for attachment to the rotating shaft 20 of a turbocharger or the like, wherein the sleeve 18 permits such attachment quickly, easily, securely, and in a manner consistent with high production requirements.

Figure 3:
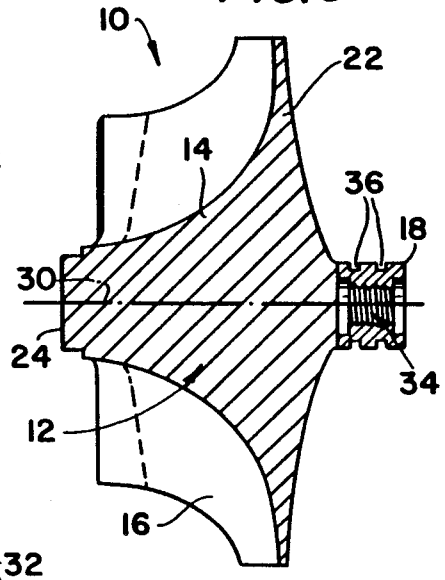
Figure 1:
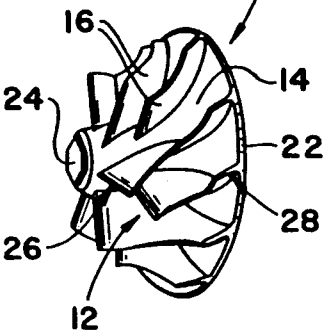
Figure 2:
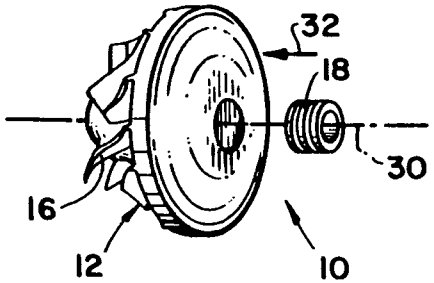
FIG. 2 is an exploded perspective view illustrating an initial step in the formation of an improved compressor wheel assembly embodying the novel features of the invention.

More particularly, with reference to FIGS. 1–3, the compressor wheel assembly 10 comprises the compressor wheel 12 formed from a relatively low inertia material, such as aluminum or a selected aluminum alloy preferably by a casting process to include the hub 14 blending smoothly in an axial direction between a diametrically enlarged backplate disk 22 at one axial end and a relatively blunt nose 24 at an opposite axial end. The hub 14, which is formed without an internal bore, is cast integrally with the circumferential array of centrifugal impeller blades 16 which project generally therefrom in a radially outward direction with a complex and smoothly curved shape to draw air or the like axially in at the nose end and to discharge that air radially outwardly from the backplate disk 22. The specific blade contouring typically includes a forward blade rake generally adjacent the nose 24 for at least some of the blades 16, as illustrated by arrow 26 in FIG. 1, and at least some backward curvature near the periphery of the backplate disk, as referred to by arrow 28.

The cast boreless compressor wheel 12 is secured to the thrust spacer sleeve 18 which is in turn adapted for connection to the rotating shaft of a turbocharger or the like. More particularly, the thrust spacer sleeve 18 is provided as a cylindrical component formed as by machining from a relatively wear-resistant metal, such as tool steel or the like, and is secured to the base or back side of the wheel backplate disk 22 in a position generally centered on a central axis 30 of the wheel 12. In this regard, as shown in FIG. 2, the base side of the backplate disk 22 has a generally planar configuration at this stage of manufacture to facilitate attachment of the sleeve 18 to the wheel.

While various attachment techniques are possible, the highly preferred method comprises inertia welding wherein, for example, the compressor wheel 12 is held stationary in a suitable fixture (not shown) while the thrust spacer sleeve 18 is advanced on a rotating tool (also not shown) in the direction of arrow 32 in FIG. 2 into friction contact with the base side of the wheel. The thrust spacer sleeve is rotated in friction contact with the compressor wheel to generate sufficient heat for fusion of the annular interface therebetween. This results in a high quality, substantially uninterrupted welded bond over substantially the entire contact areas between the wheel 12 and the sleeve 18.

After the welding step, the base side of the wheel backplate disk 22 is machined to a desired aerodynamic surface contour and surface finish, as illustrated in FIG. 3, and further to remove any upset or flash material which may have been generated during welding. The thrust spacer sleeve 18 is also machined at its inner and outer diameters for relative concentricity and coaxial centering on the central axis 30 of the compressor wheel 12. In addition, a portion of the inner diameter of the thrust spacer sleeve 18 is internally threaded, as illustrated by arrow 34 in FIG. 3, and one or more relatively shallow annular grooves 36 are formed into the outer diameter of the sleeve.

The thus-formed compressor wheel assembly 10 including the cast compressor wheel 12 and the attached thrust spacer sleeve 18 is installed quickly and easily into a turbocharger or the like. More particularly, as shown in FIG. 4, the thrust spacer sleeve threadably receives a threaded end 38 of the rotatable shaft 20 which terminates generally within a shaft opening 40 in a compressor backplate wall 42 separating a compressor housing 44 encasing the compressor wheel 12 and a so-called center housing 46 which includes a thrust bearing assembly 48 and journal bearings 50 (one of which is illustrated) for rotatably supporting the shaft 20. Conveniently, threaded installation of the wheel assembly 10 onto the shaft 20 is facilitated by forming the wheel nose 24 with a polygonal shape, such as a hexagon, (FIG. 1) or the like for engagement by an appropriate wrench or other suitable tool.

The thrust spacer sleeve 18 is threaded onto the shaft 20 into axially bearing engagement with a shoulder, such as a thrust collar 52 or the like, forming a portion of the thrust bearing assembly 48 and rotatable with the shaft. The sleeve 18 thereby spaces the compressor wheel 12 axially relative to the thrust collar 52. In addition, the sleeve 18 advantageously receives seal rings 54 in its outer diameter grooves 38 wherein these seal rings engage the inner diameter surface of the backplate wall shaft opening 40 to prevent lubricant passage from the center housing 46 into the compressor housing 44. In this regard, the thrust spacer sleeve 18 is desirably heat treated to provide a relatively hardened, wear-resistant outer diameter, wherein the heat-treating step is conveniently performed prior to inertia welding of the sleeve to the compressor wheel.

In operation, the compressor wheel 12 is positioned within the compressor housing 44 to draw in air through an inlet 55 and to discharge that air radially outwardly into a volute-shaped compressor chamber 56 in the compressor housing 44. This air movement occurs in response to rotational driving of an exhaust gas turbine (not shown) which drivingly rotates the turbocharger shaft 20 to correspondingly rotate the compressor wheel 12 at a relatively high rotational speed. Importantly, in accordance with the present invention, the compressor wheel 12 does not include any internal bore which would act as a stress riser during rotation whereby the compressor wheel 12 has a substantially prolonged fatigue life in comparison with conventional unitary cast wheels having a central bore. Moreover, the sleeve material has sufficient strength to support the assembly in a stable manner on the rotating shaft 20, and the relative direction of the engaged threads is chosen to prevent the assembly from coming off the shaft during operation. Overall efficiency and flow range of the compressor wheel, however, is not impaired, since the impeller blades 14 are formed from a casting process for optimum aerodynamic blade contour.

Figure 5:
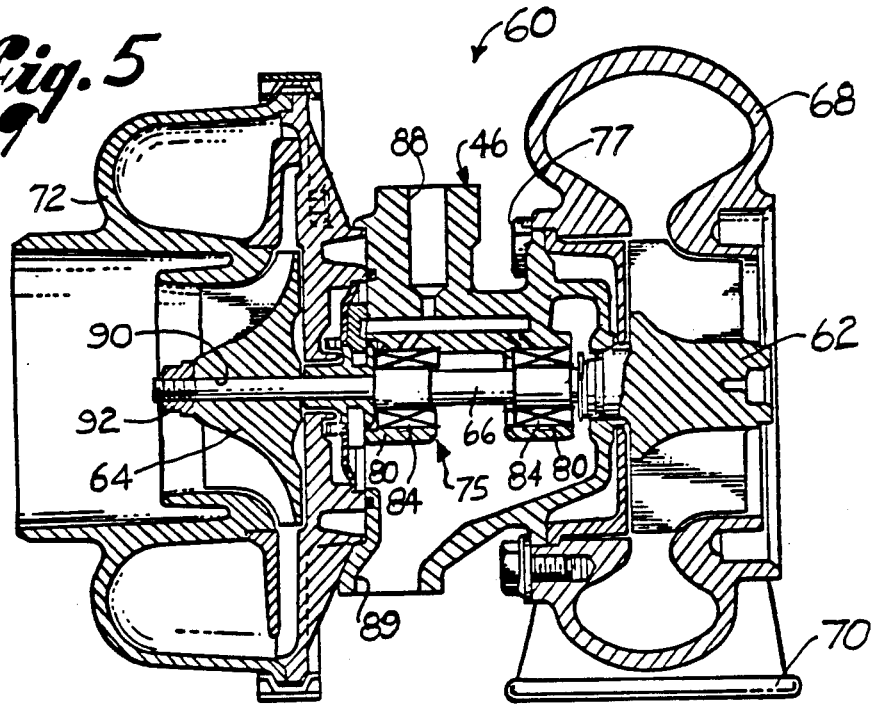
FIG. 5 is a vertical cross-sectional view of a prior art turbocharger.

A typical prior art turbocharger 60 is shown in FIG. 5 and generally comprises a turbine wheel 62 and a compressor wheel 64 mounted on opposite ends of a common shaft 66. The turbine wheel 62 is disposed within the turbine housing 68 which includes an inlet for receiving exhaust gases from an engine (not shown). The turbine housing 68 guides the engine exhaust gases into communication with and expansion through the turbine wheel 62 for rotatably driving the turbine wheel. This simultaneously rotatably drives the compressor wheel 64 which is carried within the compressor housing 72. The compressor wheel 64 and housing 72 function to draw in and compress ambient air for supply to the intake of the engine.

The turbine housing 68 and the compressor housing 72 are mounted upon an intermediate center housing 46 as by bolts 77 or the like. Center housing 46 includes a bearing carriage 75 comprising a pair of bearing bosses 80 for reception of suitable journal bearings 84 (schematically illustrated) for rotatably receiving and supporting the shaft 66. Lubricant such as engine oil the like is supplied to center housing 46 by a lubricant inlet port 88 for subsequent distribution to the turbocharger bearings. Lubricant is collected in a suitable sump or drain 89 to for passage back to the engine.

The turbocharger illustrated in FIG. 5 shows a typical prior art configuration for mounting the compressor wheel 64 upon shaft 66 by inclusion of a central bore 90 through which the shaft 66 extends to the lefthand end of the compressor wheel 66 as illustrated in FIG. 5. A locking nut 92 is threadably received on the outer threaded end of shaft 66 to secure the compressor wheel to the shaft. At the opposite end, the high temperature material turbine wheel 62 is affixed as by welding or brazing to the shaft 66. Importantly, the turbine wheel 62 conventionally does not have a central bore therethrough.

Figure 6:
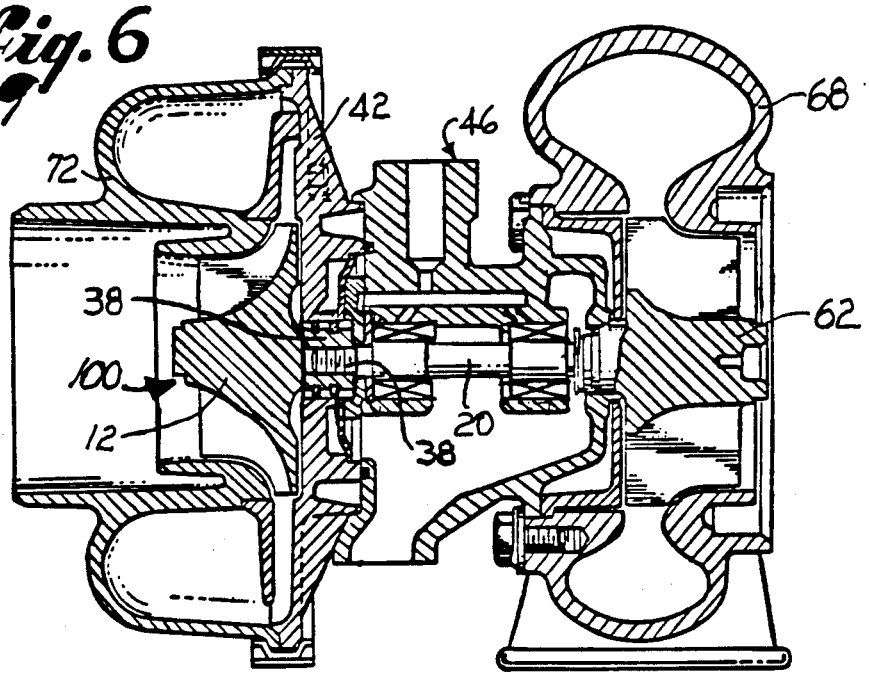
FIG. 6 is a view similar to FIG. 5 but incorporating the present invention.

FIG. 6 illustrates the present invention as discussed in detail above with regard to FIGS. 1–4 as incorporated into the turbocharger construction. The boreless compressor wheel 12 and the cylindrical thrust spacer sleeve 18 attached thereto is received on the threaded end 38 of the rotatable shaft 20. At the opposite end of rotatable shaft 20 is rigidly mounted the high temperature turbine wheel 62. Typical attachment techniques for the turbine wheel include inertial welding or brazing.

It will therefore be apparent that in FIG. 6 the boreless compressor wheel 12 along with shaft 20 and boreless turbine wheel 62 comprise an improved rotating assembly for use in turbochargers or the like. By elimination of bores in both of the rotating wheels, the present invention provides all of the advantages discussed previously.

A variety of modifications and improvements to the invention described herein are believed to be apparent to one of ordinary skill in the art. For example, further improved fatigue life characteristics may be obtained by securing the thrust spacer sleeve 18 described herein to a composite compressor wheel of the type described in concurrently filed and commonly assigned U.S. application Ser. No. 487,142 entitled Composite Compressor Wheel For Turbochargers, wherein the composite wheel includes a forged or wrought hub insert secured into a cast blade shell. In the present invention, however, the thrust spacer sleeve 18 would be secured to the composite wheel without requiring formation of any central axial bore in the composite wheel. Accordingly, no limitation on the invention is intended, except by way of the appended claims.

What is claimed is:

1. In a turbocharger having a housing:

a rotatable shaft having a threaded end;

bearing means for rotatably mounting said shaft to said housing;

a boreless turbine wheel secured to an end of said shaft opposite said threaded end;

a compressor wheel cast from a relatively low inertia material to include a boreless hub blending relatively smoothly in an axial direction between a diametrically enlarged backplate disk at one axial end end and a nose of reduced diameter at an opposite axial end, said hub integrally supporting a circumferentially arranged array of centrifugal impeller blades; and a generally cylindrical sleeve member formed from a relatively wear-resistant material in comparison with said compressor wheel, said sleeve member being secured at one axial end thereof to said one axial end of said compressor wheel in a position generally centered on a central axis of said wheel, said sleeve member further including a threaded inner diameter surface for threaded connection with said threaded end of the shaft.

2. The compressor wheel assembly of claim 1 wherein said compressor wheel is cast from a relatively lightweight aluminum material.

3. The compressor wheel assembly of claim 1 wherein said sleeve member is formed from steel.

4. The compressor wheel assembly of claim 1 wherein said sleeve member is inertia welded to said compressor wheel.

5. The compressor wheel assembly of claim 1 wherein at least some of said impeller blades have a forward blade rake generally adjacent said wheel nose and at least some backward curvature generally adjacent the periphery of said wheel backplate disk.

6. The compressor wheel assembly of claim 1 wherein said wheel nose has an axially presented generally polygonal profile for engagement by a wrench.

7. The compressor wheel assembly of claim 1 wherein said sleeve member includes a heat-treat hardened outer diameter surface.

8. The compressor wheel assembly of claim 1 wherein said sleeve member includes an outer diameter surface with at least one annular groove formed therein.

9. In a turbocharger having a housing:

a rotatable shaft having a threaded end;

bearing means for rotatably mounting said shaft to said housing;

a boreless turbine wheel secured to an end of said shaft opposite said threaded end;

a boreless compressor wheel having a boreless hub supporting a circumferentially arranged array of impeller blades; and an attachment member mounted on said hub generally at one axial end thereof in a position generally centered on a central axis of said hub, said attachment member including means for attachment to said threaded end of the shaft.

10. The compressor wheel assembly of claim 9 wherein said compressor wheel is formed from a relatively low inertia cast material and said attachment member is formed from a comparatively wear-resistant material, said attachment member being inertia welded to said compressor wheel.

11. The compressor wheel assembly of claim 9 wherein said boreless hub blends relatively smoothly between a diametrically enlarged backplate disk at one axial end thereof and a nose of reduced diameter at the opposite axial end thereof, said impeller blades comprising centrifugal impeller blades.

12. The compressor wheel assembly of claim 9 wherein said attachment member comprises a generally cylindrical thrust spacer sleeve having one axial end thereof secured to said compressor wheel.

13. The compressor wheel assembly of claim 12 wherein said sleeve includes a heat-treat hardened outer diameter surface.

14. The compressor wheel assembly of claim 12 wherein said sleeve includes an outer diameter surface with at least one annular groove formed therein.

15. A turbocharger comprising:

a rotatable shaft having a threaded end;

a shaft housing including bearing means for rotatably and axially supporting said shaft;

a turbine housing secured to said shaft housing;

a boreless turbine wheel attached to an end of said shaft opposite said threaded end;

a compressor housing defining a fluid inlet and a fluid outlet;

a compressor backplate wall separating said shaft housing and said compressor housing, said backplate wall having a shaft opening formed therein; and a compressor wheel assembly including a boreless compressor wheel having a boreless hub and a circumferentially arranged array of impeller blades; and a generally cylindrical sleeve member secured at one axial end thereof to one axial end of said compressor wheel, said sleeve member further including a threaded inner diameter surface for threaded connection with said shaft.

16. The turbocharger of claim 15 wherein said compressor wheel is formed from a relatively low inertia cast material and said attachment member is formed from a comparatively wear-resistant material, said attachment member being inertia welded to said compressor wheel.

17. The turbocharger of claim 15 wherein said boreless hub blends relatively smoothly between a diametrically enlarged backplate disk at one axial end thereof and a nose of reduced diameter at the opposite axial end thereof, said impeller blades comprising centrifugal impeller blades.

18. The turbocharger of claim 15 wherein said sleeve has an outer diameter surface with at least one annular groove formed therein, and further including a seal ring within said groove for sealing engagement with said backplate wall about said shaft opening.

19. The turbocharger of claim 15 including shoulder means within said shaft housing for axial engagement by said sleeve when said sleeve is connected to said shaft to predeterminably space said compressor wheel axially from said shoulder means.

20. The turbocharger of claim 19 wherein said shoulder means comprises a portion of said bearing means.

* * * * *